US007991312B2

(12) United States Patent
Akita

(10) Patent No.: US 7,991,312 B2
(45) Date of Patent: Aug. 2, 2011

(54) IMAGE FORMING APPARATUS FOR CONTROLLING A POTENTIAL OF AN IMAGE BEARING MEMBER

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 12/167,076

(22) Filed: Jul. 2, 2008

(65) Prior Publication Data

US 2009/0010665 A1 Jan. 8, 2009

(30) Foreign Application Priority Data

Jul. 4, 2007 (JP) ..... 2007-176299

(51) Int. Cl.
*G03G 15/02* (2006.01)
*G03G 15/043* (2006.01)

(52) U.S. Cl. ..... 399/50; 399/51

(58) Field of Classification Search ..... 399/50, 399/51, 190, 234
See application file for complete search history.

(56) References Cited

U.S. PATENT DOCUMENTS

2006/0083527 A1* 4/2006 Sakamaki ..... 399/50

FOREIGN PATENT DOCUMENTS

| | | | |
|---|---|---|---|
| JP | 08-314253 A | | 11/1996 |
| JP | 11194556 A | * | 7/1999 |
| JP | 2001-343795 A | | 12/2001 |
| JP | 2006-293240 A | | 10/2006 |

OTHER PUBLICATIONS

Machine English Translation of JP11194556.*

* cited by examiner

*Primary Examiner* — David M Gray
*Assistant Examiner* — Billy J Lactaoen
(74) *Attorney, Agent, or Firm* — Canon U.S.A., Inc., IP Division

(57) ABSTRACT

An image forming apparatus includes a charging device, an image bearing member, an electrostatic image forming device, a development device including a developer bearing member, a transfer device, and a controller. The controller controls a potential of the image bearing member such that, during image formation to form an image on a recording material having a predetermined size, an absolute potential value (V1) of a region on a surface of the image bearing member outside a region corresponding to a passage region for a recording material in a width direction orthogonal to a movement direction of the surface of the image bearing member, an absolute potential value (V2) of a non-image portion in the region corresponding to the passage region for the recording material, and an absolute potential value (Vdc) of the developer bearing member satisfy the following condition:

$$Vdc<V1<V2.$$

7 Claims, 12 Drawing Sheets

IMAGE FORMING APPARATUS FOR CONTROLLING A POTENTIAL OF AN IMAGE BEARING MEMBER

BACKGROUND OF THE INVENTION

1. Field of the Invention

The present invention relates to a development device that develops an image with a developer, and an image forming apparatus including the development device, for example, a copying machine or a printer.

2. Description of the Related Art

A two-component development system that uses a mixture of non-magnetic toner and magnetic carrier as a developer has been widely employed in conventional electrophotographic image forming apparatuses, in particular, image forming apparatuses that form color images. The two-component development system offers advantages in image quality stability and apparatus durability in comparison with other existing development systems.

However, if a large number of sheets are printed with an extremely small image area, the amount of consumption of toner is too reduced, and toner remains in the development device for a long time while being agitated, which leads to a phenomenon that the toner deteriorates. In general, toner is externally added with another kind of functional particles (external additive) to reduce adhesion or apply charges. For example, consider that polyester resin-made base toner is externally added with an external additive. In this case, however, functional particles may come off due to rubbing of toner caused by long-time agitation or the original functions imparted to the base toner may not be exerted. The deterioration of toner leads to unevenness of an image surface or causes a problem of fogging.

As discussed in, for example, Japanese Patent Application Laid-Open No. 08-314253, one countermeasure against the above problem is discharge control. This control is to consume a predetermined amount of toner after image formation if toner is not consumed for a predetermined period. Further, at the time of discharging toner, a toner discharge amount is controlled by forming various patterns of latent images. As a result, toner that has deteriorated due to agitation is discharged only in a predetermined amount to prevent the toner from remaining in the development device for a long time and deteriorating due to agitation.

Further, according to a technique discussed in Japanese Patent Application Laid-Open No. 2001-343795, in order to forcedly discharge low-tribo toner remaining in a development device for a long time, a toner patch is formed if a drum potential Vs satisfies the following relationship: (blank portion potential)−(direct current (DC) component of development bias)≦Vs−(DC component of development bias)≦0. If a result of detecting the patch indicates that a toner discharge mode should be set, the drum potential Vs that satisfies the above relationship is applied onto the entire surface when no image is formed, and low-tribo toner is discharged.

However, in the case of using the above conventional techniques, operations of the apparatus should be suspended for toner discharge control after one image formation process or between image formation processes. In other words, downtime is necessary. To that end, Japanese Patent Application Laid-Open No. 2006-293240 discusses a technique of discharging deteriorated toner from a development device to a non-image formation region positioned outside the sheet width upon passing a small-sized recording material (sheet) to reduce downtime.

If the above structure discussed in Japanese Patent Application Laid-Open No. 2006-293240 is employed, the problem of downtime is solved, but the following problem remains to be solved. To begin with, particle size distribution of general toner used for an electrophotographic process is described. In general, an average particle diameter of toner is about 5 μm to 10 μm. However, even such toner having an average particle diameter of 5 μm shows particle size distribution with a certain level of variation.

The inventor of the present invention made extensive studies and found that, among toner particles that were rubbed for the same period, toner particles having a small particle diameter cause the above surface unevenness or fogging. In addition, the inventor found that such toner having a small particle diameter can be effectively discharged by reducing a potential difference Vback between anon-image formation region and a development sleeve, and a discharge efficiency varies depending on the potential difference Vback.

In addition, in the case of discharging toner to the non-image portion positioned along a recording material width direction so as to reduce downtime, as discussed in Japanese Patent Application Laid-Open No. 2006-293240, a toner discharge area is limited compared with the case of discharging toner after image formation or when no image is formed as in the conventional technique. As a result, if conventional discharge control is performed, toner having an average particle diameter in the development device is used for development. This may hinder efficient discharge and makes it difficult to reduce downtime as well as to reduce fogging.

SUMMARY OF THE INVENTION

The present invention is directed to an image forming apparatus that can effectively reduce fogging even if a discharge area is limited due to a structure for discharging toner to a region outside a recording material passage region of an image bearing member surface in a width direction orthogonal to a movement direction to reduce downtime.

According to an aspect of the present invention, an image forming apparatus includes a charging device configured to charge an image bearing member, an electrostatic image forming device configured to form an electrostatic image on the charged image bearing member, a development device including a developer bearing member configured to bear and convey a developer containing toner and carrier, and configured to apply a voltage to the developer bearing member to develop the electrostatic image to form a toner image, a transfer device configured to transfer the toner image on the image bearing member to a recording material, and a controller capable of performing a mode of controlling a potential of the image bearing member such that, during image formation to form an image on a recording material having a predetermined size, an absolute potential value (V1) of a region on a surface of the image bearing member outside a region corresponding to a passage region for the recording material in a width direction orthogonal to a movement direction of the surface of the image bearing member, an absolute potential value (V2) of a non-image portion in the region corresponding to the passage region for the recording material, and an absolute potential value (Vdc) of the developer bearing member satisfy the following condition:

$$Vdc<V1<V2.$$

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
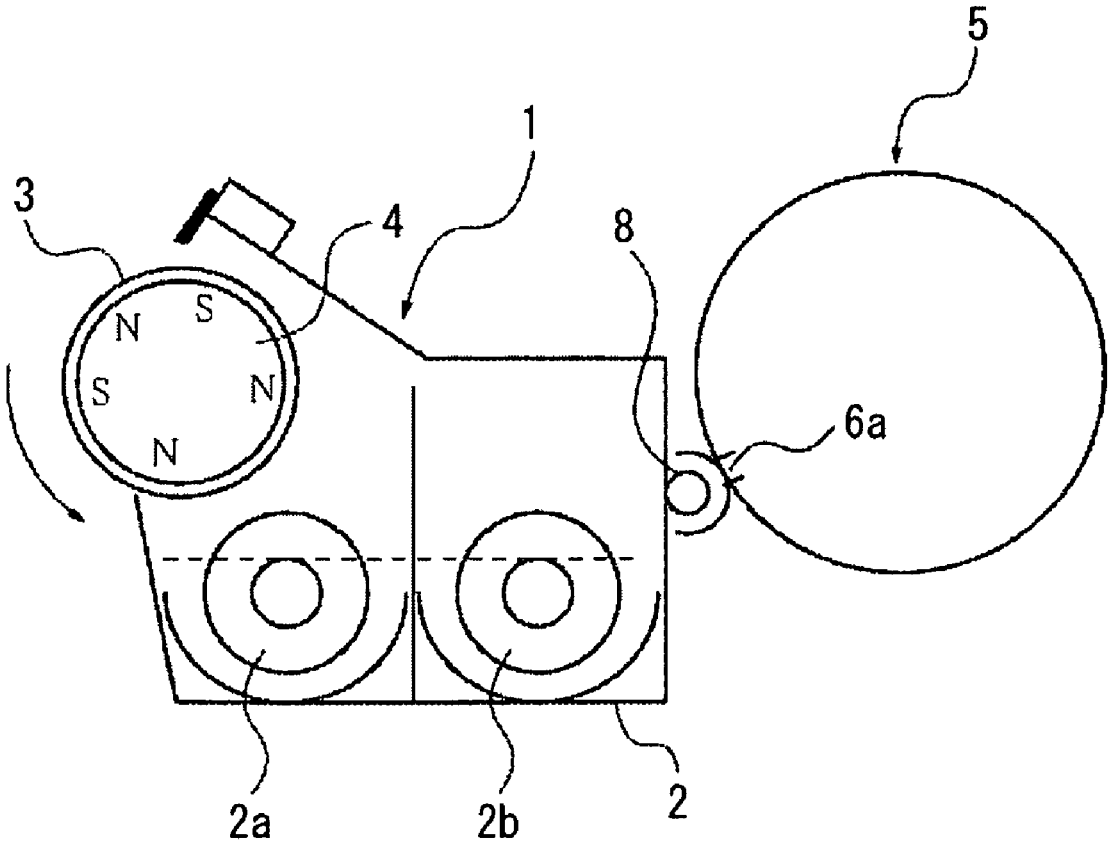
FIG. 1 is a sectional view of a development device according to an exemplary embodiment of the present invention.

Referring to FIGS. 1 to 7, a development device and an image forming apparatus according to a first exemplary embodiment of the present invention are described. FIG. 1 is a sectional view of a development device 1 according to the present exemplary embodiment. A device main body of the development device 1 contains a two-component developer composed of non-magnetic toner and magnetic carrier. An initial toner density of the developer is 7%.

This density value should be appropriately adjusted based on a charge amount of toner, a carrier particle diameter, and the structure of the image forming apparatus. Therefore, the toner density is not limited to the above value. The device main body of the development device 1 is partially opened to define a development region opposite a photosensitive drum (image bearing member) 28 (see FIG. 2). A development sleeve (developer bearing member) 3 is rotatably set in the opening in a state of partially extending from the opening.

The development sleeve 3 is made of a non-magnetic material and includes a stationary magnet 4 that generates a magnetic field. The development sleeve 3 rotates in a direction of the arrow in FIG. 1 during a development operation to bear and convey the two-component developer in a development container 2 towards the development region to supply the two-component developer to the development region opposite the photosensitive drum 28 and to develop an electrostatic latent image formed on the photosensitive drum 28.

Figure 10:
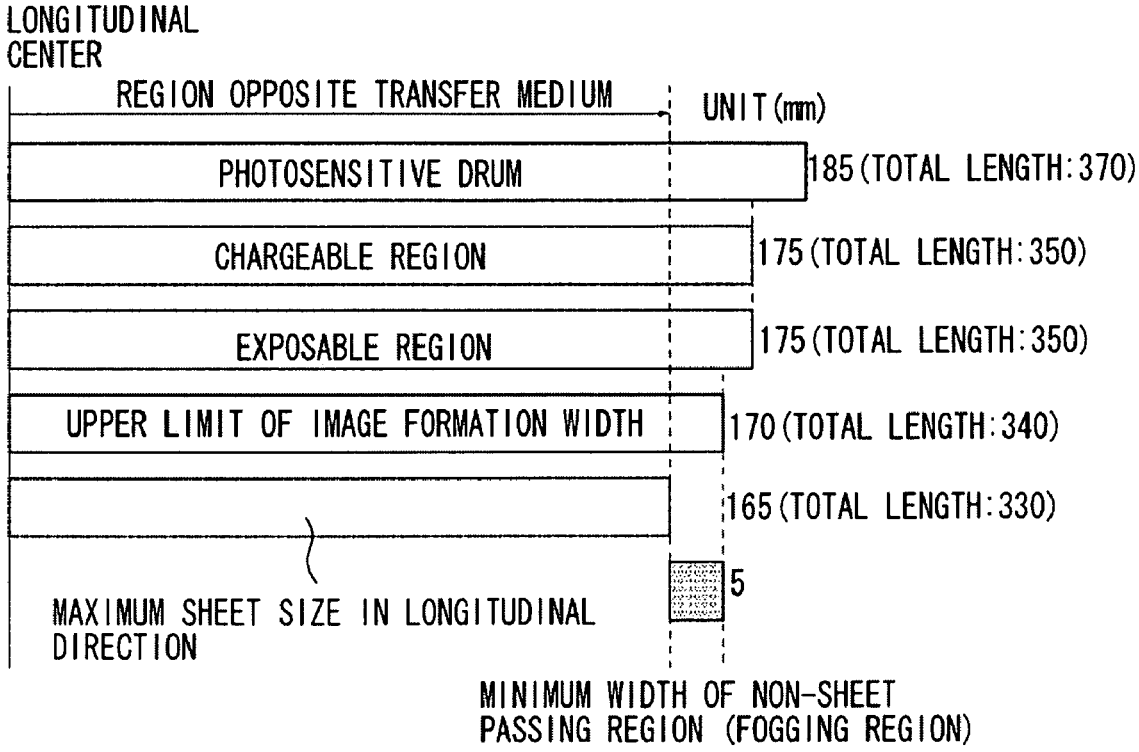
FIG. 10 illustrates a longitudinal size of each portion of an image forming apparatus according to an exemplary embodiment of the present invention.

In the present exemplary embodiment, the minimum distance between the development sleeve 3 and the photosensitive drum 28 is set to 300 μm. The image forming apparatus according to the present exemplary embodiment has such a specification that the maximum sheet size in longitudinal direction is 330 mm and the upper limit of image formation width is 340 mm, which value is 10 mm longer than the maximum sheet size, as illustrated in FIG. 10. The upper limit of image formation width corresponds to the maximum area that allows the formation of a toner image. This area refers to a longitudinal region of the development sleeve 3 on which a developer is born.

In addition, a sandblast region on the surface of the development sleeve 3 and the position of the stationary magnet 4 are set such that a developer bearing region of the development sleeve 3 measures 340 mm across. Further, a photosensitive drum length is set to 370 mm, and a length of a chargeable region that allows charging with a charging device and a length of an exposable region that allows exposure with an exposure device are set to 350 mm, such that the upper limit of image formation width completely falls within an exposure/charging portion inclusive of a component tolerance. The reason the upper limit of image formation width is set larger than the maximum sheet size is a significant factor in the present exemplary embodiment.

Figure 11:
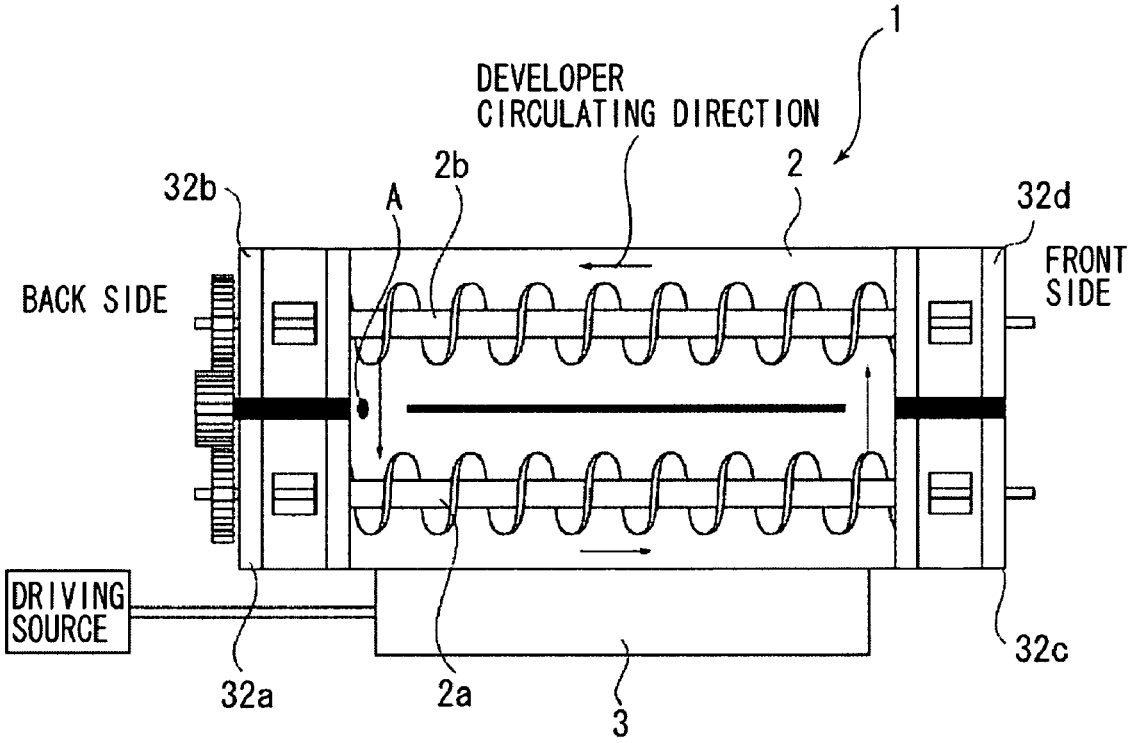
FIG. 11 is a top view illustrating an inner portion of a development device according to an exemplary embodiment of the present invention.

FIG. 11 is a top view of an inner portion of the development device 1. After the development of a latent image, the residual two-component developer on the development sleeve 3 is conveyed along with the rotation of the development sleeve 3 and recovered into the developer container 2. The developer recovered into the developer container 2 is circulated, mixed, and agitated again in the developer container 2 by two screws, a first screw 2*a* (close to the development sleeve 3) and a second screw 2*b* (far from the development sleeve 3).

The developer circulates in a direction extending from the back side to the front side in FIG. 11 on the first screw 2*a* side, and in a direction extending from the front side to the back side in FIG. 11 on the second screw 2*b* side. The first screw 2*a* and the second screw 2*b* are axially supported by the developer container 2 as a supporting member via bearings 32*a* to 32*d* as a bearing member. The front bearings 32*c* and 32*d* and the rear bearings 32*a* and 32*b* are adjacent each other.

Figure 3:
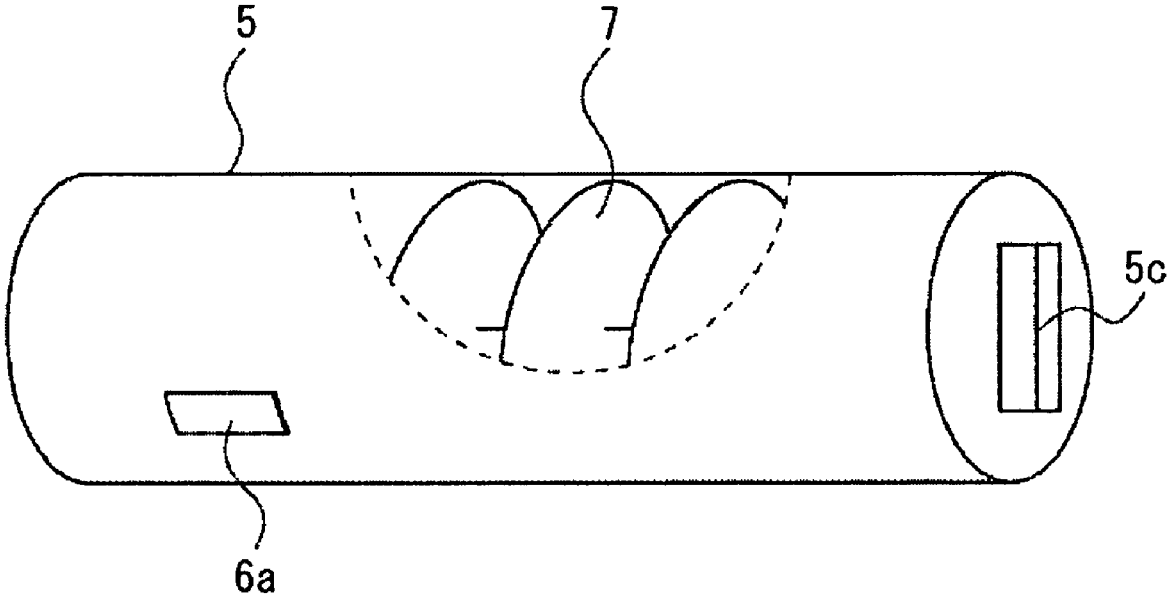
FIG. 3 is a partial exploded perspective view of a developer cartridge.

A toner cartridge 5 for supplying new toner is approximately cylindrical and is detachably attached to the image forming apparatus main body (development device main body). FIG. 3 is a partial exploded perspective view of the toner cartridge 5 removed from the apparatus main body. The toner cartridge 5 is inserted into the image forming apparatus main body from the front side thereof and is rotated by turning a front-side knob 5*c* to the right. Along with the rotation, a toner replenishing port 6*a* is opened.

In the case of removing the toner cartridge 5 from the image forming apparatus main body, the toner replenishing port 6*a* is closed by turning the knob 5*c* to the left to prevent the leakage of any packed powder to the outside. Further, the toner cartridge 5 incorporates an agitating member 7 for agitating toner. The agitating member 7 has a spiral resin film, which can be rotated around a rigid shaft.

The agitating member 7 has the following functions: The agitating member 7 is rotated to agitate toner in the toner cartridge 5 and assists in replenishment of toner. An amount of toner corresponding to toner used for image formation is conveyed to a replenishment screw 8 attached to the development container 2 from the toner cartridge 5 via the toner replenishing port 6*a* by the rotational force of the agitating member 7 and gravity. Then, the toner is replenished into the development container 2 according to the rotation of the replenishment screw 8. In this way, replenishment toner is replenished from the toner cartridge 5 to the device main body of the development device 1.

Further, a replenishment amount of toner is roughly determined based on a rotational speed of the replenishment screw 8. This rotational speed is determined by a toner replenishment amount control unit (not illustrated).

Next, the two-component developer, containing toner and carrier, used in the present exemplary embodiment is described. The toner includes colored resin particles, containing a binder resin, a colorant, and optionally other additives, and colored particles externally added with an external additive, such as a colloidal silica fine powder. The toner is a negatively-charged polyester resin. Its volume mean particle diameter can be 5 μm or more and 8 μm or less. In the present exemplary embodiment, the volume mean particle diameter is 5.8 μm.

Examples of the carrier include surface-oxidized or unoxidized iron, nickel, cobalt, manganese, chromium, and rare-earth metal, and an alloy thereof, and ferrite oxide. A method for manufacturing the magnetic particles is not particularly limited. The carrier has a weight mean particle diameter of 20 μm to 50 μm, alternatively, 30 μm to 40 μm. In addition, its resistivity is $10^7$ Ωcm or more, alternatively, $10^8$ Ωcm or more. In the present exemplary embodiment, the carrier resistivity is $10^8$ Ωcm or more.

The toner used in the present exemplary embodiment is measured of a volume mean particle diameter by use of the following device and method. A measuring device is an electric-resistance type particle diameter distribution measurement device SD-2000 (available from Sysmex Corporation) A 1% NaCl aqueous solution prepared with primary sodium chloride was used as an electrolytic solution. The measurement method is as follows.

To elaborate, 0.1 ml of a surfactant, e.g., alkylbenzenesulfonate, is added as a dispersant to 100 ml to 150 ml of the electrolytic solution, and 0.5 mg to 50 mg of a measurement sample is added thereto. The electrolytic solution to which the sample is suspended is dispersed for about 1 to 3 minutes with an ultrasonic dispersion device. Then, particle size distribution of particles having a diameter of 2 μm to 40 μm is measured using the above device SD-2000 with a 100 μm-aperture to determine volume mean distribution. The volume mean particle diameter is determined based on the thus-obtained volume mean distribution.

Figure 2:
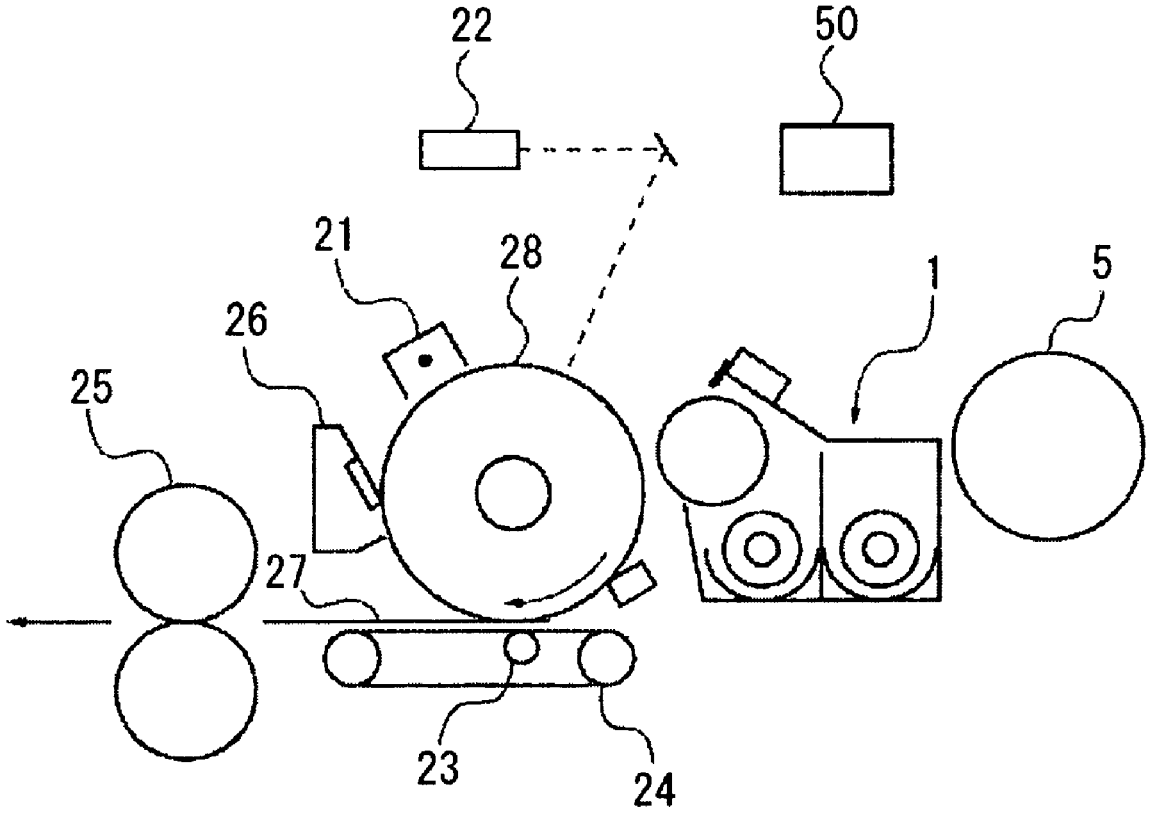
FIG. 2 is a sectional view of an image forming apparatus according to an exemplary embodiment of the present invention.

FIG. 2 is a sectional view of the image forming apparatus according to the first exemplary embodiment of the present invention. In FIG. 2, the surface of the photosensitive drum 28 as an image bearing member, which is uniformly charged by a charging device 21, is first exposed to laser light by a laser (exposure device) 22 as an electrostatic image forming apparatus to form an electrostatic image on the photosensitive drum 28. Then, the electrostatic image is developed by the development device 1 to form a toner image on the photosensitive drum 28.

In the present exemplary embodiment, an inversion development process is used. According to this process, toner is caused to adhere to a light portion (image portion) exposed to the laser light. The toner image on the photosensitive drum 28 is transferred onto a recording sheet (transfer medium) 27 conveyed on a transfer belt 24 due to a transfer bias applied to a transfer device 23. Then, the recording sheet 27 having the toner image transferred thereonto is separated from the transfer belt 24 and pressed and heated by a fixing device 25 to form a permanent image. The transfer residual toner on the photosensitive drum 28 is removed by a cleaner (cleaning device) 26, and the apparatus becomes ready for the next image formation.

In general, in a two-component development device, a potential difference is set between a non-image portion and a development sleeve to prevent developing a toner image onto the non-image portion (not to cause fogging). This potential difference is inverse to that between an image portion and the development sleeve. This potential difference between the non-image portion and the development sleeve is hereinafter referred to as a fogging-removal potential difference (Vback).

This potential difference is set by utilizing the phenomenon that, since toner in the development device has a predetermined polarity, toner keeps away from the non-image portion due to the fogging-removal potential difference. In contrast, if the fogging-removal potential difference Vback is large, coulomb force generated due to the fogging-removal potential difference influences the positively-charged magnetic carrier. The coulomb force exceeds a magnetic bearing force of the development sleeve, and the carrier can easily adhere to a blank portion (non-image portion) of the photosensitive drum.

Figure 4:
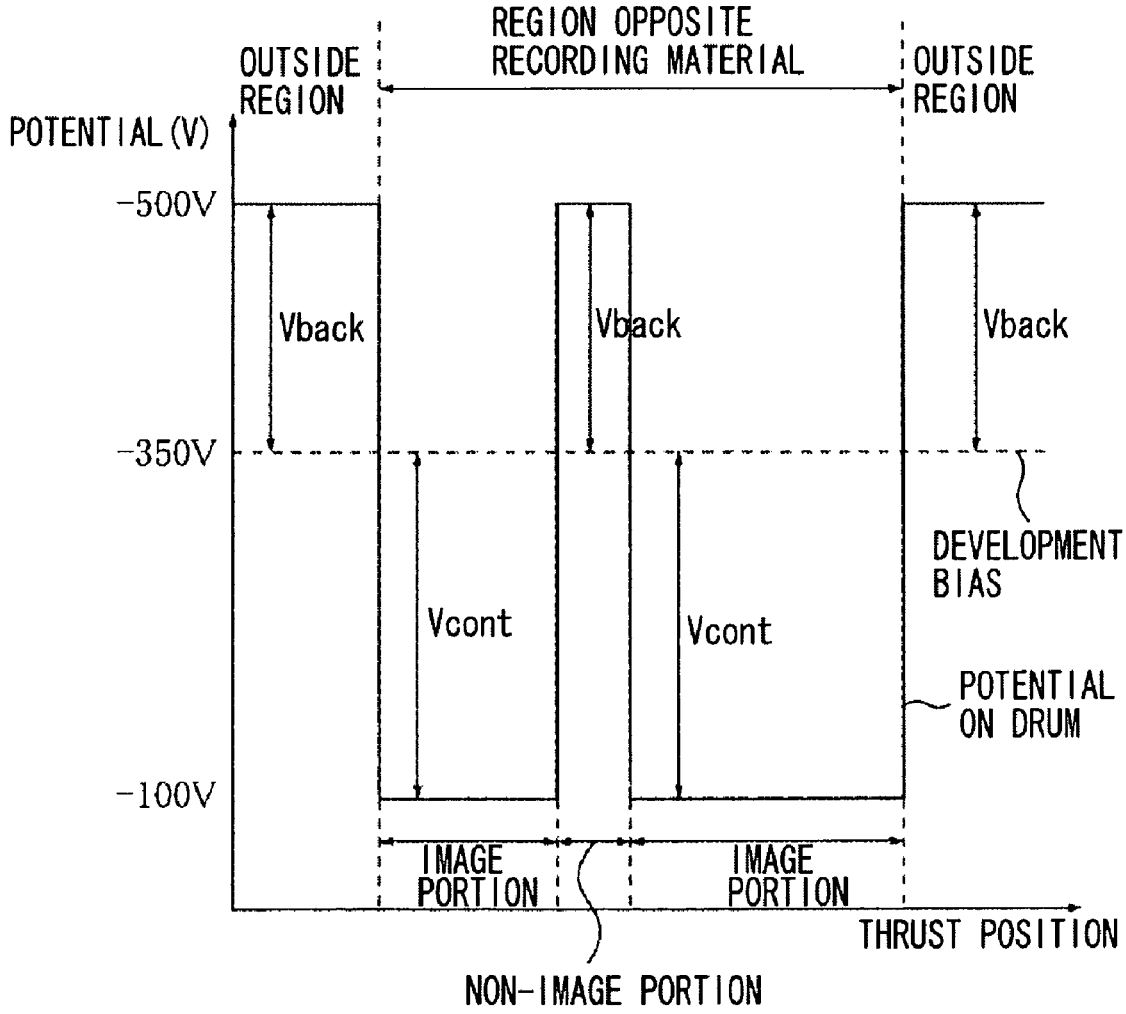
FIG. 4 is a potential relationship diagram illustrating a potential relationship between regions of an image forming apparatus.

Accordingly, the fogging-removal potential difference Vback is set to an appropriate potential difference based on a magnetic flux density of a development pole of the development sleeve or toner characteristics and carrier characteristics. FIG. 4 illustrates a potential on the drum surface (image bearing member surface) in a longitudinal direction of the photosensitive drum 28 after the laser light application to the photosensitive drum 28 charged by the charging device 21 with the laser 22, and a voltage applied to the development sleeve 3 (development bias potential).

In the present exemplary embodiment, negative toner, which is negatively charged, is used as the toner. The negative toner is developed to an exposure portion (image portion) on the negatively-charged photosensitive drum 28 to visualize a toner image. As illustrated in FIG. 4, the surface of the photosensitive drum 28 is uniformly charged by the charging device 21 up to a surface potential of −500 V. Further, a region opposite the recording material refers to a region positioned opposite the recording material in a longitudinal direction of the photosensitive drum 28 during the transfer operation. The image portion is exposed with laser and its potential is −100 V.

The non-image portion has a potential of −500 V. A development bias for developing an image to the image portion is −350 V. A development potential (Vcont) corresponding to a difference between a potential of the exposure portion exposed with the laser 22 and the development bias potential is 250 V, and toner is developed onto the photosensitive drum 28. On the other hand, a blank portion (non-image portion) potential is −500 V. Thus, a fogging-removal potential difference (Vback) corresponding to a difference between the development bias potential and the blank portion potential is 150 V.

As a result, fog toner is attracted back to the development sleeve 3 from the photosensitive drum 28. The fogging-removal potential difference prevents the fog toner from adhering to the blank portion (non-image portion) on the transfer material (recording material). The above development bias is a DC voltage. In the present exemplary embodiment, the DC voltage that is superimposed with an AC rectangular bias having a peak-to-peak voltage of 1.5 kV is used as the development bias. The above description is directed to a normal mode corresponding to a normal image formation operation.

Figure 7:
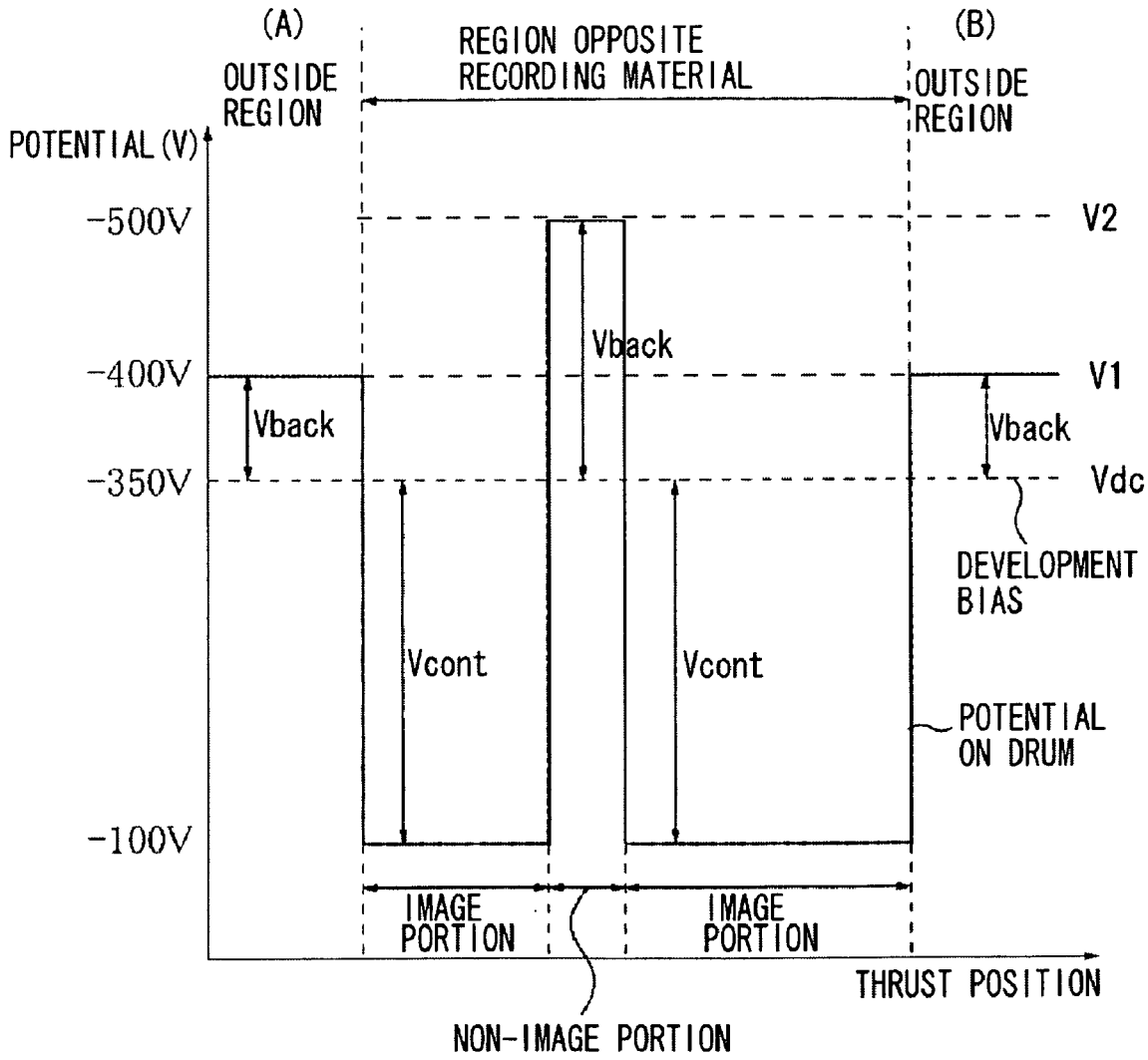
FIG. 7 is a potential relationship diagram illustrating a potential relationship between regions of an image forming apparatus upon discharging fog toner according to an exemplary embodiment of the present invention.

Next, an operation and effect of discharging deteriorated toner with a fogging-removal potential difference are described with reference to FIG. 7. In the present exemplary embodiment, in regions A and B outside the region opposite a recording material in the longitudinal direction (regions corresponding to portions on which no image is finally formed), the photosensitive drum 28 is temporarily charged to −500 V similar to the image portion. After that, the regions A and B are slightly exposed with the laser 22 to set the surface potential of the photosensitive drum 28 to −400 V, so that the fogging-removal potential difference Vback is set to 50 V.

As described above, in general, the fogging-removal potential difference Vback is set to prevent developing a toner image on the non-image portion. In the present exemplary embodiment, an appropriate value of the fogging-removal potential difference Vback, which is necessary to prevent development of the negative toner to the non-image portion in an image formation region, is 150 V as described above. Thus, the fog toner tends to remain on the photosensitive drum 28 in the non-image portion if the fogging-removal potential difference Vback is 50 V.

Figure 9:
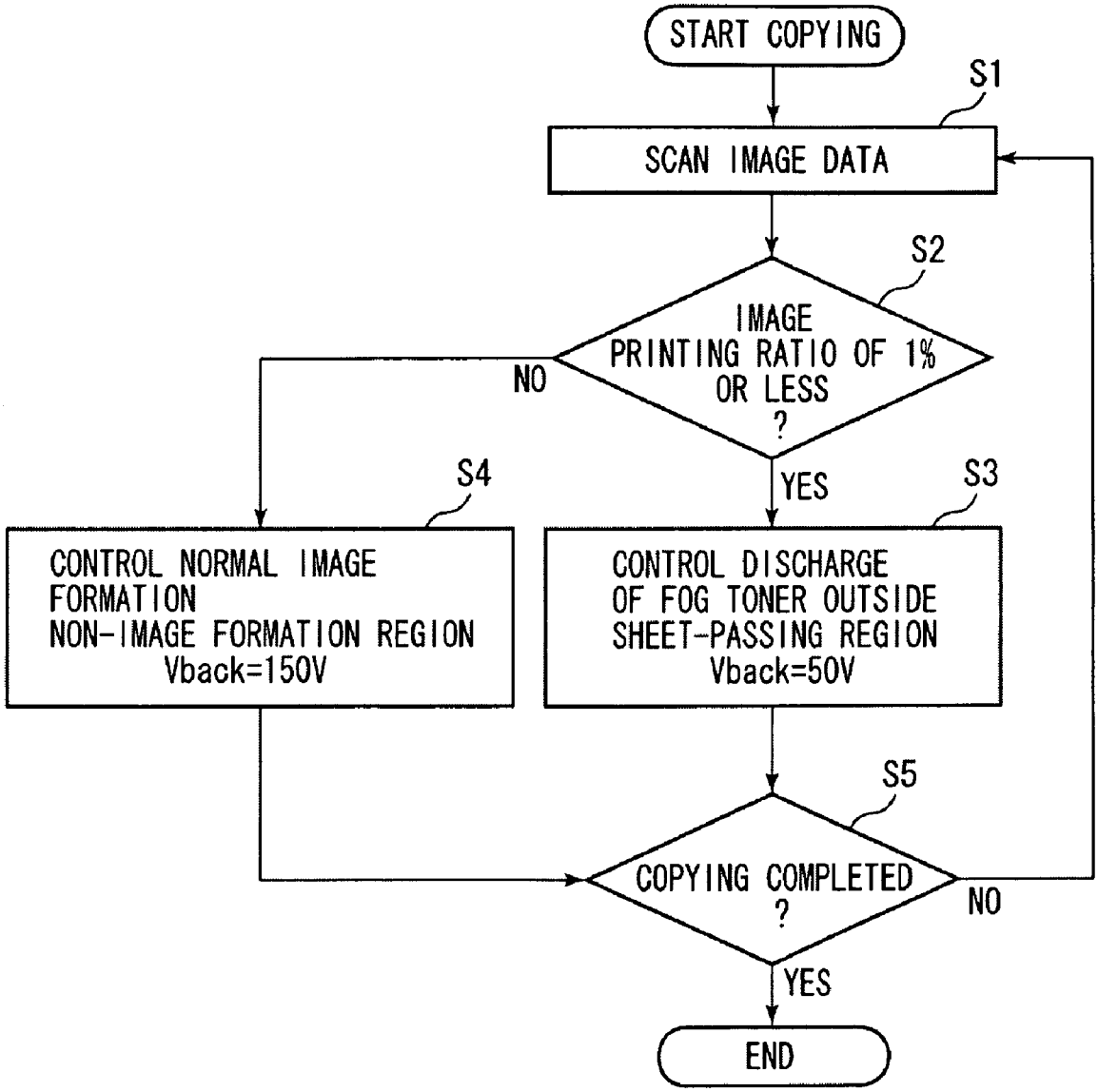
FIG. 9 is a flowchart illustrating a control operation according to an exemplary embodiment of the present invention.

In the present exemplary embodiment, this phenomenon is utilized. As illustrated in FIG. 9, in step S1, a control unit 50 (FIG. 2) reads image data for each image. In step S2, the control unit 50 detects an image printing ratio based on the image data. In step S2, the control unit 50 determines whether the image printing ratio is a predetermined value (e.g., 1%) or less. If the image printing ratio is the predetermined value or less (YES in step S2), then in step S3, the control unit 50 performs an operational mode for reducing a fogging-removal potential difference Vback in a region outside the region opposite a recording material.

More specifically, the control unit 50 performs a mode of controlling a potential of the image bearing member (photosensitive drum 28) such that, during image formation to form an image on a recording material having a predetermined size, an absolute potential value (V1) of a region on a surface of the image bearing member outside a region corresponding to a passage region for the recording material in a width direction orthogonal to a movement direction of the surface of the image bearing member, an absolute potential value (V2) of a non-image portion in the region corresponding to the passage region for the recording material, and an absolute potential value (Vdc) of the developer bearing member (development sleeve 3) satisfy the following condition:

$$Vdc<V1<V2.$$

Figure 12:
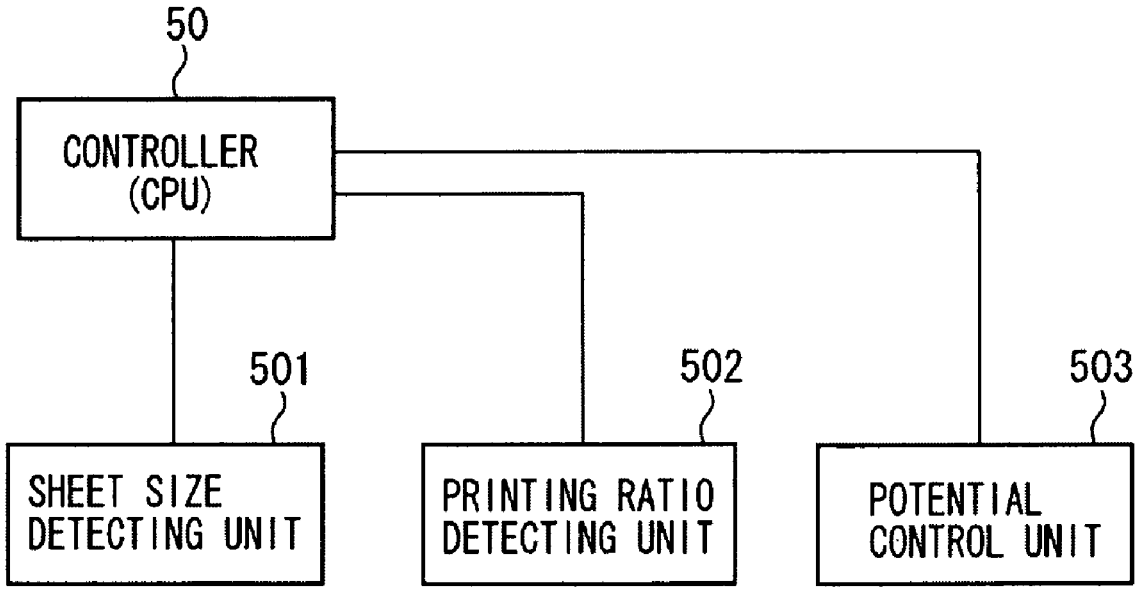
FIG. 12 is a block diagram illustrating control units according to an exemplary embodiment of the present invention.

In this mode, the degree of fogging in the outside area is increased. Accordingly, the fog toner increases the consumption of toner. On the other hand, if the image printing ratio is larger than the predetermined value (NO in step S2), then in step S4, the control unit 50 performs a normal image formation mode. In step S5, the control unit 50 determines whether copying or printing is completed. If it is determined that copying or printing is not yet completed (NO in step S5), the processing returns to step S1. If it is determined that copying or printing is completed (YES in step S5), the processing ends. FIG. 12 is a block diagram illustrating a configuration for performing the above mode. The controller 50 receives signals from a sheet size detecting unit 501 and a printing ratio detecting unit 502 to control a potential control unit 503. The potential control unit 503 controls a potential of the photosensitive drum 28 in such a way as to satisfy the potential relationship of Vdc<V1<V2.

This mode enables effective discharge of fine toner particles, which may cause fogging. Accordingly, even if toner is discharged to a limited region outside a region corresponding to a passage region for the recording material in a longitudinal direction of the photosensitive drum 28 so as to reduce downtime, fogging can be effectively reduced.

A video count value of an image density of an image information signal of an image read with a charge-coupled device (CCD) is used for detecting an image printing ratio in the present exemplary embodiment. In other words, output signals from an image signal processing circuit are counted on a pixel basis, and the count value for all pixels in a document sheet is accumulatively added to determine a video count value T per document sheet. An image printing ratio per job is calculated based on the video count value with the printing ratio of 100% (complete solid).

Then, if the image printing ratio per job is not larger than a predetermined threshold value (in the present exemplary embodiment, 1%), the fogging-removal potential difference Vback in the outside region is set to 50 V, and toner is consumed due to fogging. If the image printing ratio is larger than 1%, normal image formation is carried out. In other words, a fogging-removal potential difference Vback in the outside region is set to 150 V as in the non-image portion.

In the present exemplary embodiment, the threshold value is set to 1%. However, the degree of deterioration of toner during idle agitation varies depending on a developer or development hardware structure. Thus, the above threshold value can be arbitrarily set based on the developer or development hardware structure. Thus, it is unnecessary to perform image formation at long intervals for toner discharge control in order to consume toner using a non-image region during image formation.

Further, consuming toner as fog toner is advantageous in that image defects, such as unevenness or fogging, which occur during continuous printing of low-printing-ratio images, can be effectively prevented. To describe the reason therefor in detail, as discussed in the description of the related art, among toner particles rubbed and deteriorated due to long-term agitation in the development device, toner particles having a smaller particle diameter out of toner particles having certain particle size distribution tend to cause image defects, such as fogging or unevenness.

Figure 5:
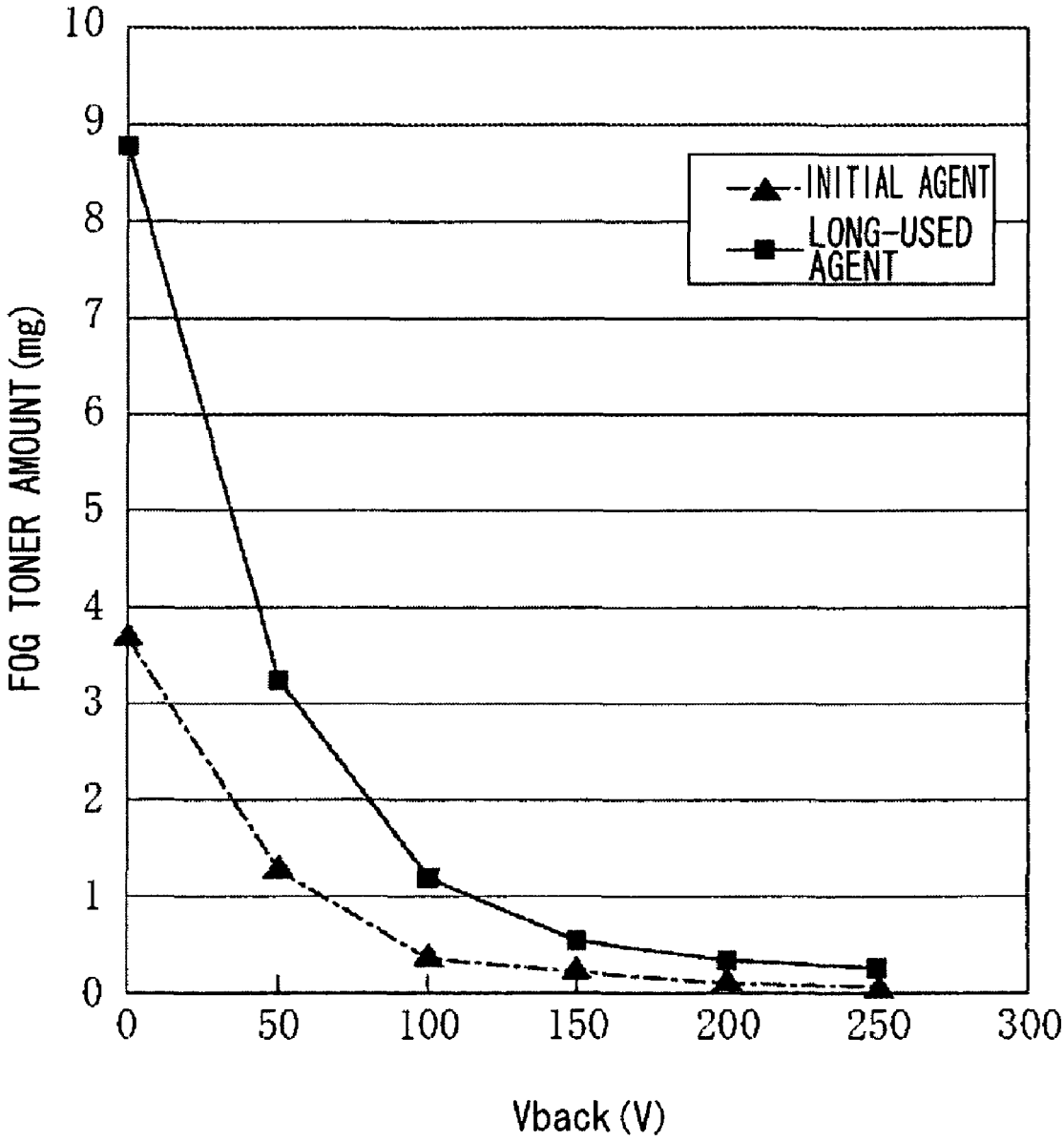
FIG. 5 is a graph illustrating a relationship between each of a fog toner amount of initial toner (toner that has been used only for a short time) and a fog toner amount of long-used toner (toner that has been used for a long time) and a potential difference Vback.
Figure 6:
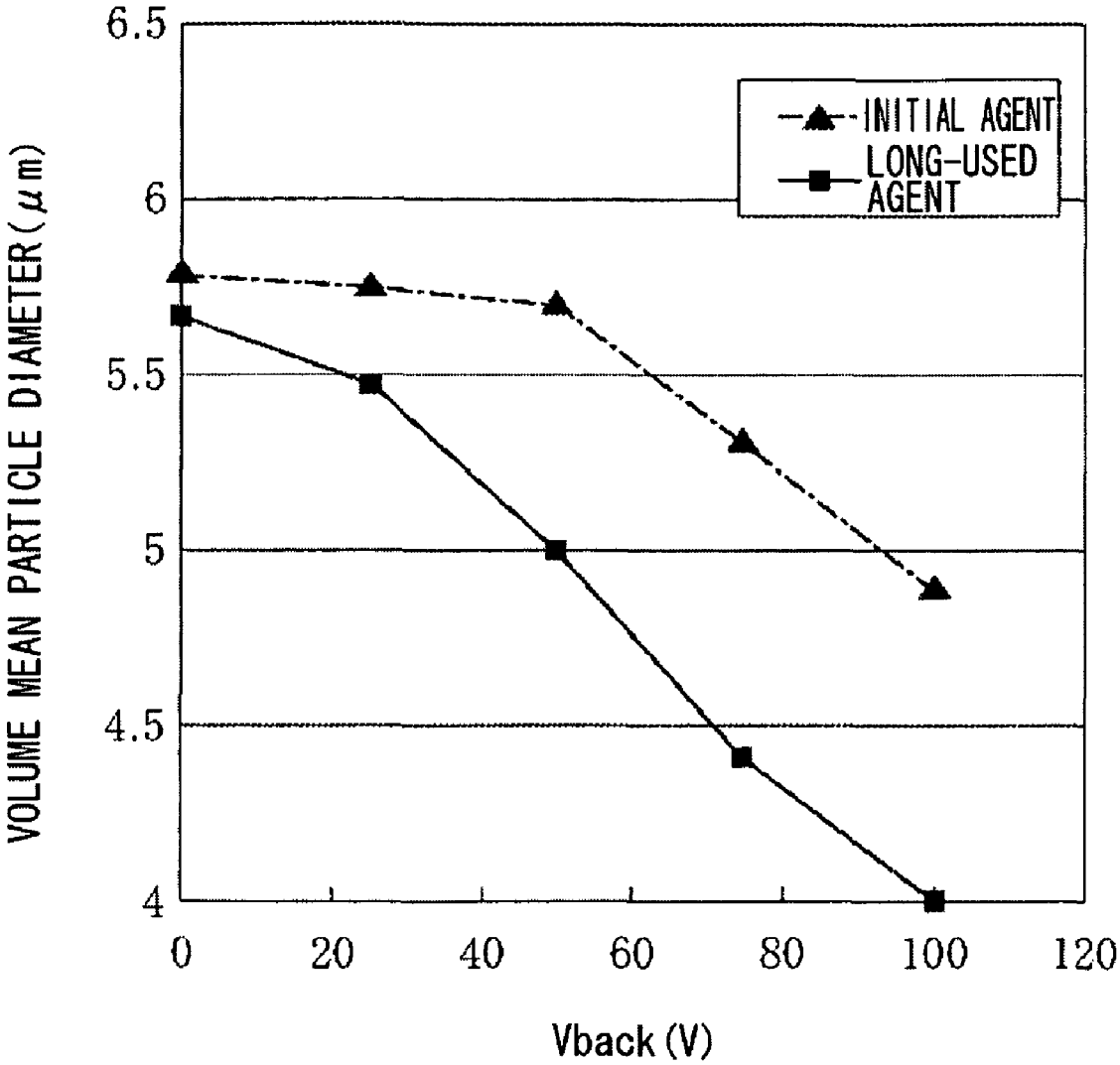
FIG. 6 is a graph illustrating a relationship between each of a fog toner particle diameter of initial toner and a fog toner particle diameter of long-used toner and a potential difference Vback.
Figure 8:
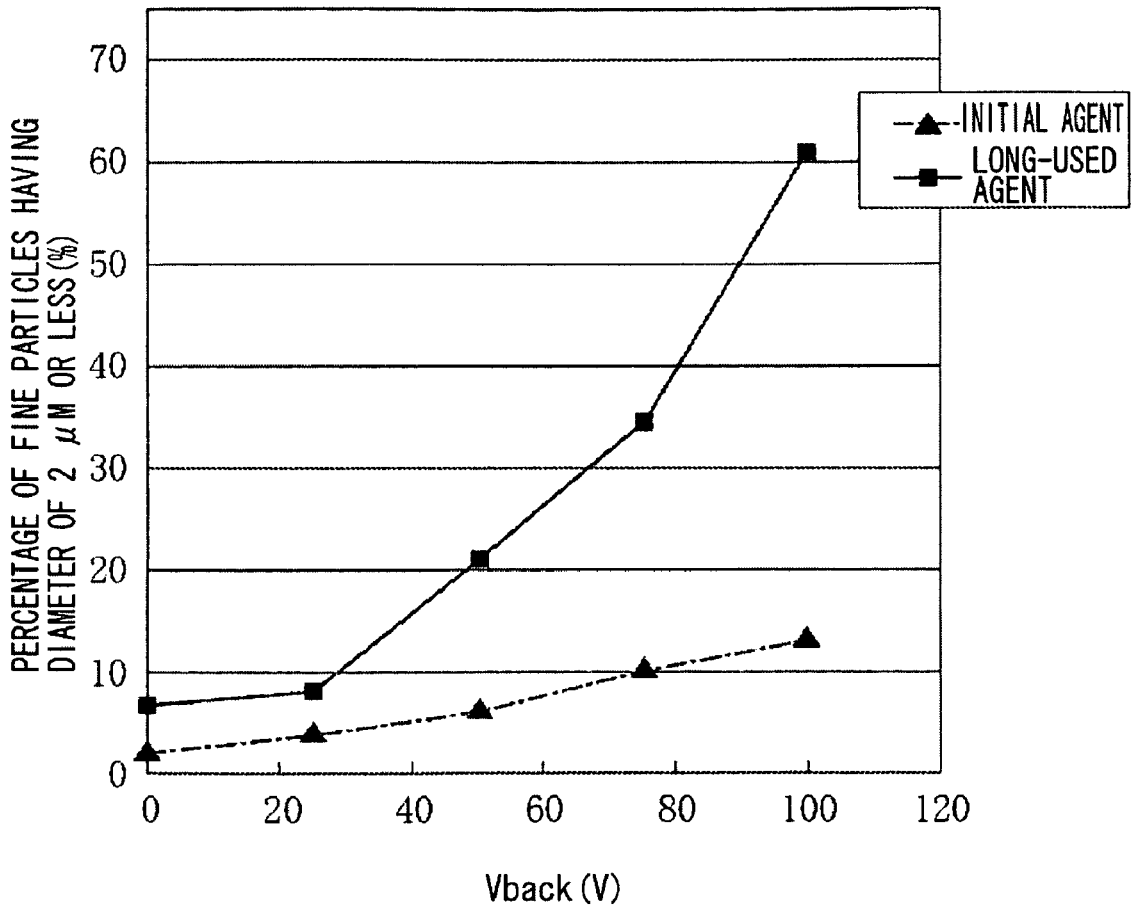
FIG. 8 is a graph illustrating a relationship between each of the percentage of fog toner having a particle diameter of 2 μm or less in initial toner and that in long-used toner and a potential difference Vback.

FIG. 5 illustrates a relationship between each of a fog toner amount of an initial developer and a fog toner amount of a long-used agent after the passage of a predetermined number of blank sheets, and the fogging-removal potential difference Vback. As illustrated in FIG. 5, the fog toner amount of the long-used agent is larger than that of the initial agent with respect to the fogging-removal potential difference Vback. FIGS. 6 and 8 illustrate a relationship between the fogging-removal potential difference Vback and a fog toner average particle diameter of an initial agent on the photosensitive drum and that of a long-used agent on the photosensitive drum, and a relationship between the fogging-removal potential difference Vback and the percentage of fine particles in the initial agent and that in the long-used agent (a ratio of particles having the diameter of 2 μm or less to the total toner particles).

As apparent from a result of comparing particle size distribution of fog toner of the initial agent and that of the long-used agent in FIGS. 6 and 8, the fog toner of the long-used agent has a smaller particle diameter than that of the initial agent. In short, fine toner particles tend to cause fogging after the long-term use. As a result, it is found that fine toner particles in toner particles deteriorated due to long-term agitation mainly cause fogging.

The reason the long-used fine toner particles tend to cause fogging is as follows. In many cases, the base toner is externally added with an external additive, such as silica, for example. As is well known, the toner with the external additive has an effect of reducing non-electrostatic adhesion compared with toner added with no additive. By reducing the non-electrostatic adhesion, toner images are faithfully developed according to an electric field between a latent image on the photosensitive drum and a bias applied to the development sleeve.

However, there is a possibility that the external additive externally added to the toner is being rubbed for a long time in the development device, and thus comes off or infiltrate to the base toner to impair the original function of reducing non-electrostatic adhesion. As described above, if the function of reducing non-electrostatic adhesion is impaired, a toner image to be faithfully developed onto the photosensitive drum non-electrostatically adheres to a non-latent-image portion, and in addition, cannot be removed using the fogging-removal potential difference Vback. As a result, image defects, such as fogging, occur.

To describe the phenomenon in detail, as the toner particle diameter is decreased, a toner charge amount proportional to the toner surface area is reduced. Hence, non-electrostatic adhesion increases relative to an electrostatic force based on the electric field generated with the fogging-removal potential difference Vback. As a result, fine toner particles may tend to cause fogging. The unevenness is supposedly caused by the long-used fine toner particles for the same reason. If latent images formed on the photosensitive drum with a high definition can be faithfully reproduced by toner images, unevenness does not occur. The unevenness is caused due to small density variations that occur if toner is applied onto a non-image portion that is not a latent image. In other words, unevenness and fogging are similar to each other in terms of toner adhering to a non-image portion on a photosensitive member. Accordingly, the unevenness is supposedly caused by the long-used fine toner particles like the fogging.

As described above, fine toner particles among toner particles idly agitated for a long time chiefly cause the unevenness/fogging with a printing ratio. Accordingly, if the fine toner particles are consumed preferentially, wasteful toner consumption can be prevented and image defects, such as unevenness/fogging, can be reduced.

In the present exemplary embodiment, a weak electric field generated with the fogging-removal potential difference Vback is used to fog the toner using a region outside the region opposite a recording material during image formation to effectively consume deteriorated fine toner particles. As described above, a charge amount per particle of the fine toner is smaller than the large one and an influence of the non-electrostatic adhesion is accordingly increased relative to the large one. Therefore, the fine toner cannot be easily controlled with a force of the electric field generated with the fogging-removal potential difference Vback.

Hence, unless the fine toner particles are applied with the high electric field generated with the fogging-removal potential difference Vback, non-electrostatic adhesion on the photosensitive drum cannot be reduced. In particular, the above phenomenon often occurs in toner of high non-electrostatic adhesion, which is deteriorated due to long-term use. By utilizing the tendency, in the present exemplary embodiment, toner is fogged using the electric field generated with the fogging-removal potential difference Vback to efficiency consume the deteriorated fine toner. As illustrated in FIGS. 6 and 8, it is useful to increase a fogging-removal potential difference Vback so as to efficiently consume fine toner particles among toner particles having a certain particle size distribution.

However, as illustrated in FIG. 5, if the fogging-removal potential difference Vback is too large, an amount of fog toner is reduced, and a desired amount of toner cannot be consumed. Therefore, an appropriate fogging-removal potential difference Vback is determined based on a relationship between the percentage of fine toner particles and a fog toner amount. In the present exemplary embodiment, the fogging-removal potential difference Vback for discharging fine toner is set to 50 V from this point of view.

An advantage according to the present exemplary embodiment and a result of comparing the present exemplary embodiment and the related art are summarized in Table 1 below.

TABLE 1

| | | Result (a) Discharge toner amount per image (mg) | Result (b) Ratio of particles of 2 μm or less to total discharge toner | Result (c) Toner amount of particles of 2 μm or less in discharge toner (mg) |
|---|---|---|---|---|
| Experiment (a) | Discharge control with Vback of 50 V (initial) | 1.4 | 6% | 0.084 |
| Experiment (b) | Discharge control with Vback of 50 V (long-used) | 3.3 | 20% | 0.66 |
| Experiment (c) | Discharge control of related art | 3.4-6.8 | 2% | 0.068-0.136 |

In Table 1, Experiment (a) and Experiment (b) are experiments according to the present exemplary embodiment. A developer in Experiment (a) is an initial developer, and that in Experiment (b) is a long-used developer. Experiment (c) is an experiment of the related art. Here, the related art is a technique of calculating a printing ratio of a formed image and executing toner discharge control if the calculated printing ratio is below a predetermined value (for example, 2%). According to this technique, a toner discharge amount is set such that the sum of the discharge toner amount and an amount of toner consumed for image formation becomes a toner consumption amount corresponding to a printing ratio of 2%.

At this time, the photosensitive drum is exposed to laser light such that an absolute potential value of the photosensitive drum is smaller than an absolute value of a DC component of a development bias, and toner images are developed to the exposure portion to discharge toner. Further, in Table 1, Result (a) shows a discharge amount per image upon toner discharge operation. Result (b) shows a ratio of toner particles having the particle diameter of 2 μm or less to the discharged toner. Result (c) shows the weight of toner particles having the particle diameter of 2 μm or less in the discharged toner.

As apparent from Table 1, when the fogging-removal potential difference Vback is set to 50 V, a toner discharge amount is about 1.4 mg to 3.3 mg (the total amount of fog toner developed to both end portions of each A4-sized sheet). This value is smaller than a toner discharge amount of the related art in a low-printing-ratio mode. In many cases, toner discharge control of the related art with a low printing ratio is executed such that the toner amount is set to an amount corresponding to an average printing ratio of about 1% to 2% or more.

More specifically, if an image of a printing ratio of 0% is formed like a solid blank image, 3.4 mg to 6.8 mg of toner (per A4-sized image) corresponding to the printing ratio of 1% to 2% is discharged (coating amount of toner is 0.55 mg/cm$^2$). In the present exemplary embodiment, as illustrated in FIG. 8, a ratio of fine particles to the fog toner with the fogging-removal potential difference Vback of 50 V (a ratio of particles having a particle diameter of 2 μm or less to the total toner particles) is 20%, which value is about 10 times as large as the ratio (2%) of fine particles during normal development. The ratio of fine particles during normal development refers to a ratio of fine toner particles measured upon developing a normal image.

A discharge amount of fine toner particles having a particle diameter of 2 μm or less, which may cause image defects, in a low-printing-ratio mode is larger in the present exemplary embodiment than in the related art as illustrated in Table 1. As a result, image defects, such as unevenness/fogging, can be prevented even with an extremely small toner discharge amount compared with a discharge amount in the related art. Since the above structure is used, in the present exemplary embodiment, as illustrated in FIG. 10, a charging operation, an exposure operation, and a development operation are performed with a region longer than at least the maximum sheet size (longitudinal direction).

Here, fog toner at both end portions non-electrostatically adhere to the photosensitive drum 28 with a small charge amount. Thus, the toner is hardly transferred with the transfer device and is recovered to the cleaning device (cleaner 26) after being conveyed on the photosensitive drum 28. In some cases, fog toner is transferred onto a transfer roller albeit a small amount. In this case, the toner may be recovered with transfer roller cleaning.

The above potential on the photosensitive drum, development bias, development potential Vcont, and fogging-removal potential difference Vback are not limited to the above values and can be appropriately changed according to a developer or apparatus structure. As described above, according to the present exemplary embodiment, long-used toner is consumed as fog toner to preferentially consume deteriorated fine toner, which tends to cause image defects. As a result, an efficient discharge operation can be performed with no downtime.

Second Exemplary Embodiment

In the first exemplary embodiment, the potential difference Vback of the non-image formation region is uniformly set to 50 V regardless of a size of a longitudinal image region, that is, a recording material (sheet size). In contrast, according to a second exemplary embodiment of the present invention, a value of the fogging-removal potential difference Vback in a region outside a region opposite a recording material, which is set upon low-duty discharge, is changed based on a longitudinal size of a recording material. In the second exemplary embodiment, components are similar to those of the first exemplary embodiment, and similar components to those of the first exemplary embodiment are denoted by the same reference numerals.

As described in the first exemplary embodiment, a fogging-removal potential difference Vback is reduced in an outside region during image formation to consume deteriorated toner in the form of fog toner. An area of the outside region varies depending on the longitudinal size of a sheet. For example, there is a difference of 87 mm between a length of the outside region in an A4-sized sheet having the longitudinal sheet size of 297 mm and that in an A4R-sized sheet having the longitudinal sheet size of 210 mm.

Accordingly, the consumption of fog toner in the outside region upon the passage of the A4R-sized sheet is, of course, larger than upon the passage of the A4-sized sheet. In other words, upon the passage of the A4R-sized sheet, deteriorated toner is discharged too much compared with the A4-sized sheet. Accordingly, if the A4R-sized sheet is set, a fogging-removal potential difference Vback is set to 70 V compared with a fogging-removal potential difference Vback of 50 V for the A4-sized sheet.

Thus, a fog amount per unit area is reduced such that the total amount of fog toner can be uniformly set irrespective of a sheet size. Further, in the case of using a small-sized sheet, e.g., an A5R-sized sheet, a fogging-removal potential difference Vback can be set to 110 V. As described in the first exemplary embodiment, a ratio of fine particles in the fog toner increases as an electric field generated with the fogging-removal potential difference Vback becomes high. Therefore, the larger the fogging-removal potential difference Vback, the more efficiently the deteriorated fine toner is consumed.

However, if the fogging-removal potential difference Vback is increased, a discharge amount of fog toner is reduced. Thus, the potential difference Vback is set to 50 V in consideration of fine toner discharge efficiency and the total amount of fine toner in the case of using the A4-sized sheet. In other words, in the case where a sheet having a small longitudinal sheet size is used, even if the fogging-removal potential difference Vback is set large, a non-sheet passing region area is large and thus, the total amount of fog toner can be increased. Accordingly, a larger amount of deteriorated fine toner can be discharged with a larger fogging-removal potential difference Vback.

As described above, the control in the second exemplary embodiment is performed to set an appropriate fogging-removal potential difference Vback in a non-image formation region according to a sheet size. Accordingly, a toner discharge operation can be efficiently performed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-176299 filed Jul. 4, 2007, which is hereby incorporated by reference herein in its entirety.

What is claimed is:

1. An image forming apparatus comprising:

a charging device configured to charge an image bearing member;

an electrostatic image forming device configured to form an electrostatic image on the charged image bearing member;

a development device including a developer bearing member configured to bear and convey a developer containing toner and carrier, and configured to apply a voltage to the developer bearing member to develop the electrostatic image to form a toner image;

a transfer device configured to transfer the toner image on the image bearing member to a recording material; and a controller capable of performing a mode of controlling a potential of the image bearing member such that, during image formation to form an image on a recording material having a predetermined size, an absolute potential value (V1) of a region on a surface of the image bearing member outside a region corresponding to a passage region for the recording material in a width direction orthogonal to a movement direction of the surface of the image bearing member, an absolute potential value (V2) of a non-image portion in the region corresponding to the passage region for the recording material, and an absolute potential value (Vdc) of the developer bearing member satisfy the following condition:

$$Vdc<V1<V2,$$

wherein the controller is capable of changing the absolute potential value V1 according to a length in a width direction orthogonal to a conveying direction of the recording material.

2. The image forming apparatus according to claim 1, wherein, if a length in a width direction orthogonal to a conveying direction of the recording material is shorter than a predetermined length, the controller increases the absolute potential value V1.

3. The image forming apparatus according to claim 1, wherein the electrostatic image forming device includes an exposure device configured to expose a surface of the image bearing member, and wherein the controller controls the potential of the image bearing member by causing the exposure device to expose the region on the surface of the image bearing member outside the region corresponding to the passage region for the recording material in a width direction orthogonal to a movement direction of the surface of the image bearing member.

4. The image forming apparatus according to claim 1, wherein the controller performs the mode of controlling the potential of the image bearing member if an image printing ratio of a formed image is a predetermined value or less.

5. An image forming apparatus comprising:

a charging device configured to charge an image bearing member;

an electrostatic image forming device configured to form an electrostatic image on the charged image bearing member;

a development device including a developer bearing member configured to bear and convey a developer containing toner and carrier, and configured to apply a voltage to the developer bearing member to develop the electrostatic image to form a toner image;

a transfer device configured to transfer the toner image on the image bearing member to a recording material; and a controller capable of performing a mode of controlling a potential of the image bearing member such that, during image formation to form an image on a recording material having a predetermined size, an absolute potential value (V1) of a region on a surface of the image bearing member outside a region corresponding to a passage region for the recording material in a width direction orthogonal to a movement direction of the surface of the image bearing member, an absolute potential value (V2) of a non-image portion in the region corresponding to the passage region for the recording material, and an absolute potential value (Vdc) of the developer bearing member satisfy the following condition:

$$Vdc<V1<V2,$$

wherein, if a length in a width direction orthogonal to a conveying direction of the recording material is shorter than a predetermined length, the controller increases the absolute potential value V1.

6. The image forming apparatus according to claim 5, wherein the electrostatic image forming device includes an exposure device configured to expose a surface of the image bearing member, and wherein the controller controls the potential of the image bearing member by causing the exposure device to expose the region on the surface of the image bearing member outside the region corresponding to the passage region for the recording material in a width direction orthogonal to a movement direction of the surface of the image bearing member.

7. The image forming apparatus according to claim 5, wherein the controller performs the mode of controlling the potential of the image bearing member if an image printing ratio of a formed image is a predetermined value or less.

* * * * *